US005339071A

United States Patent [19]

Eckhaus

[11] Patent Number: 5,339,071

[45] Date of Patent: Aug. 16, 1994

[54] SHOCK SENSOR

[76] Inventor: Ira Eckhaus, 3221 Skillman Ave., Oceanside, N.Y. 11572

[21] Appl. No.: 38,712

[22] Filed: Mar. 26, 1993

[51] Int. Cl.[5] ..... G08B 21/00

[52] U.S. Cl. ..... 340/665; 200/61.45 R; 340/669

[58] Field of Search ..... 340/665, 571, 669; 200/61.45 R, 61.51, 61.48, 61.49

[56] References Cited

U.S. PATENT DOCUMENTS 4,190,828 2/1980 Wolf ..... 200/61.45 R
4,679,033 7/1987 Hwang ..... 200/61.45 R
4,764,762 8/1988 Almour ..... 200/61.45 R

*Primary Examiner*—John K. Peng
*Assistant Examiner*—Benjamin C. Lee
*Attorney, Agent, or Firm*—Helfgott & Karas

[57] ABSTRACT

An electrical shock sensor having a housing containing an electrically conductive plug member having a conical configuration. An electrically conductive collar member is coaxially positioned over the conical configuration. An electrically conductive spring is connected between the annular collar and a stationary part within the housing. A first electrical connection is made to the plug member and a second electrical connection is made to reach the conductive spring. The shock sensor is included within a burglar alarm including an energy source and an alarm means. Natural vibrations will cause the spring to oscillate or vibrate without moving the collar. However, impact onto the shock sensor will cause the spring to sufficiently jar thereby displacing the annular collar from its position with respect to the conical surface.

13 Claims, 2 Drawing Sheets

SHOCK SENSOR

BACKGROUND OF THE INVENTION

This invention relates to an electrical switching element, and more particularly, to a shock sensor which will serve to open a closed electrical circuit when moved or jarred thereby permitting an alarm to be triggered.

In burglar alarm systems, and the like, it is typical to utilize sensors to detect when a particular item has been moved. By way of example, on doors and windows, motion detectors or shock sensors can be placed on these members and included within a closed circuit burglar alarm system. When the window is shattered or the door jarred, the motion causes the shock sensor to detect such movement, thereby breaking the circuit and causing an alarm to be triggered.

Such motion detectors or shock sensors can also be used in automobile burglar alarms, which can detect the movement of the car itself or someone trying to open the door or break the window thereby causing the shock sensor to detect such movement. The circuit will then break and trigger the alarm.

Although in most cases, such shock sensors are used as part of closed circuits, it is also possible that the shock sensor can be utilized as part of an open circuit system whereby the movement of the object on which the shock sensor is placed will cause the shock sensor to close the circuit, thereby triggering the alarm.

One of the important aspects of the shock sensor is that it must be sensitive enough in order to detect any slight motion. At the same time, it should be able to discriminate between false and actual alarm conditions. It should also be adjustable for proper sensitivity since each situation may differ from the other. For example, in certain places where the windows are shaky and are subject to continuous wind movement, less sensitivity is required in the shock sensor. On the other hand, where the windows are rather rigid, greater sensitivity may be given to the shock sensor.

SUMMARY OF THE INVENTION

Accordingly, it is an object of the invention to provide an improved shock sensor which can be easily adjusted to provide a desired sensitivity.

Another object of the invention is to provide a shock sensor which can discriminate between false and actual alarm conditions.

A further object of the present invention is to provide a shock sensor which will provide effective and immediate reaction to the motion of an object on which the shock sensor has been mounted.

Still another object of the present invention is to provide a shock sensor which can be easily manufactured, readily installed and can be produced at reduced manufacturing costs.

Yet a further object of the present invention is to provide a shock sensor which can be made of very small configuration and yet provide accurate and sensitive reaction to the movement of the object on which the shock sensor is placed.

Another object of the present invention is to provide a shock sensor which can be utilized either in closed circuit systems or open circuit systems, to provide an indication of the movement of an object on which the shock sensor has been placed.

Briefly, in accordance with the present invention, there is provided an electrical shock sensor which includes a housing which contains the various electrical parts. Within the housing there is slidably housed an electrically conductive plug member having a conical configuration. A wire is coupled to the plug member and extends outwardly of the housing for attachment to one terminal of a source of electrical energy. Located within the housing and positioned over the plug member is an electrically conductive annular collar. The annular collar is permitted to engage along the conical surface and is positioned so that it can move into and out of engagement with the conical surface.

An electrically conductive spring is connected between the annular collar and a stationery part within the housing. An additional wire is coupled to the spring either directly or through an intermediary member, and extends to the other terminal of the source of electrical energy. The housing is mounted on an object to be monitored for movement. Disturbance of the housing by movement of the object causes the spring to vibrate thereby displacing the annular collar from the conical surface moving into and out of electrical contact with the plug member. In this manner, if the shock sensor is part of a closed circuit system, it will break the closed circuit. On the other hand, if it is part of an open circuit, the movement causes the annular member to make contact with the conical surface thereby closing the circuit.

The plug member with its conical surface can be axially moved within the housing by means of an external adjustment screw to thereby initially position the conical surface with respect to the annular collar. In this manner, the sensitivity of the shock sensor can be adjusted by adjustment of the axial position of the conical surface.

BRIEF DESCRIPTION OF THE INVENTION

Figure 3:
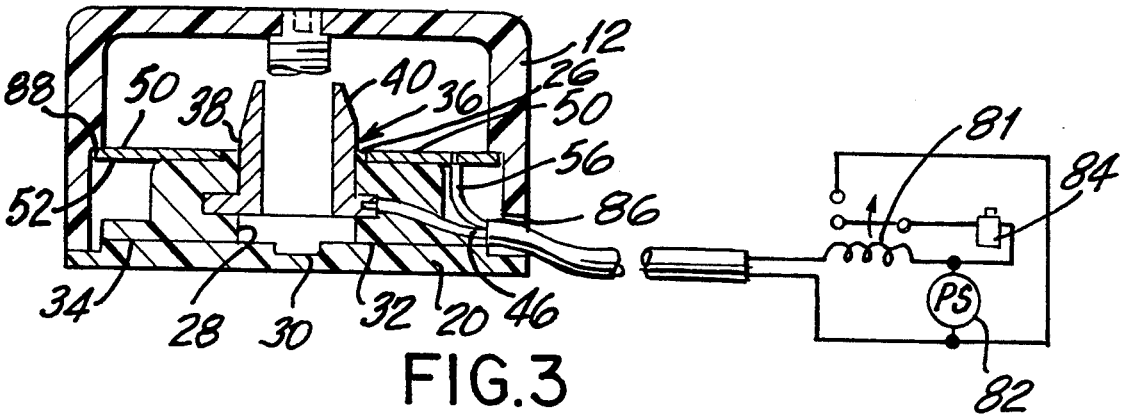
Figure 4:
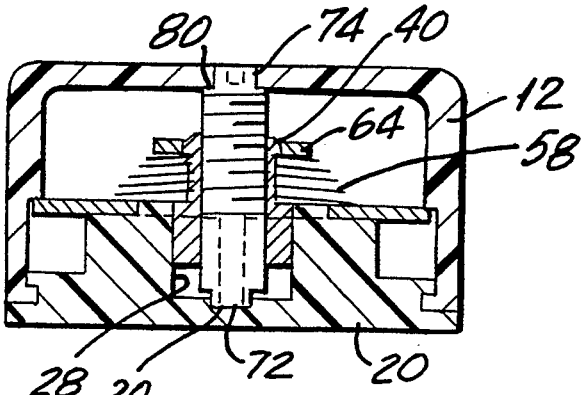

FIG. 3 is a cross-sectional view taken transversely across the guide pins of the plug member of the shock sensor, and for simplification is shown without the spring and annular collar and showing the interconnection of the shock sensor and the electrical circuit, and FIG. 4 is a cross-sectional view taken substantially perpendicular to that of FIG. 3 of the shock sensor but now showing all of the parts of the interior of the housing.

In the figures like reference numbers designate like parts.

DESCRIPTION OF THE PREFERRED EMBODIMENT

Figure 1:
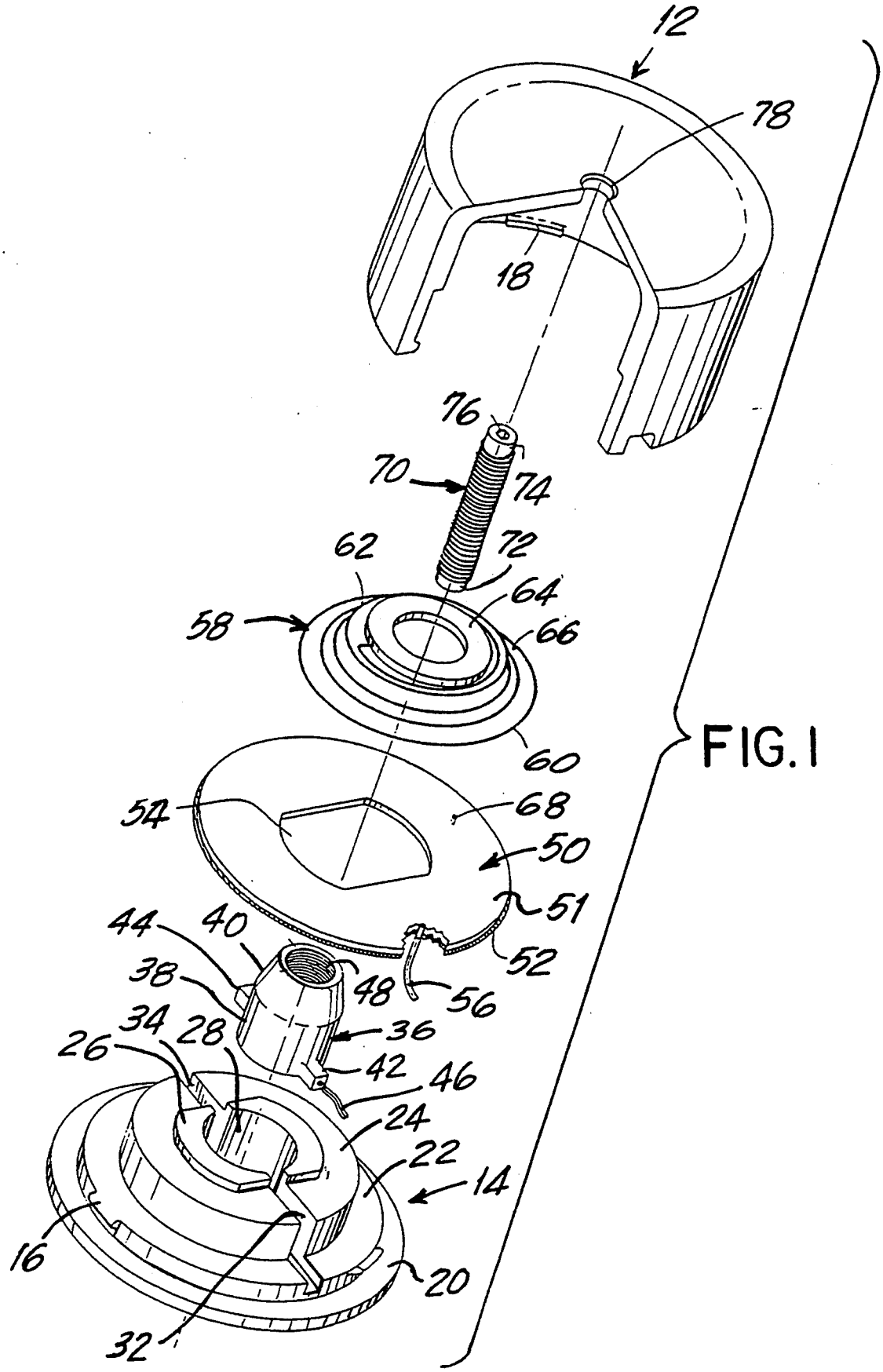
FIG. 1 is an exploded prospective view of the shock sensor in accordance with this invention.
Figure 2:
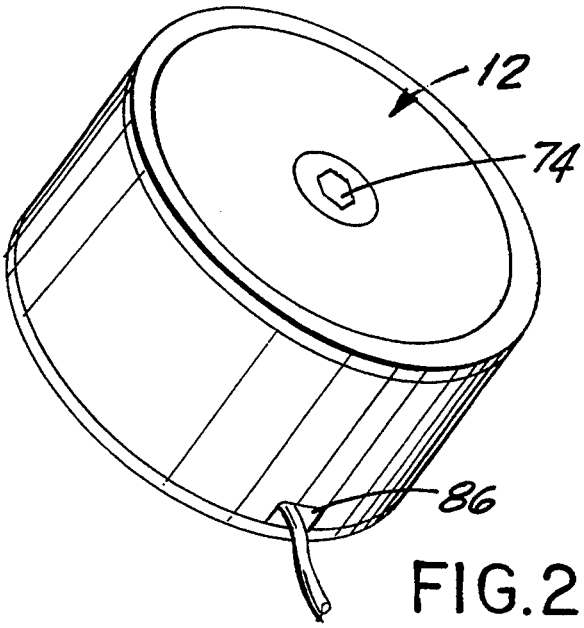
FIG. 2 is a prospective view of the exterior of the shock sensor.

With reference now to FIG. 1, there is shown an exploded view of a shock sensor in accordance with the present invention, comprising a substantially cylindrical housing 12 having an open bottom which fits on to a base portion 14 and is secured thereto by means of a snap together fit involving the projecting ridges 16 on the base portion which engage the projecting lip portions 18 extending from the interior of the housing 12.

The base portion 14 comprises a lower substantially circular level 20 which is the part that is secured on to the member to be monitored, such as a window, door or the like. Sitting on the lower circular level is a second level 22 having a smaller diameter than the outer lower level 20. Thereon is a third layer 24, again of smaller diameter than the previous two levels. An upstanding boss 26 is on the upper level and has a pair of flats on two of its sides.

A central aperture 28 is formed downwardly through the levels 22 and 24. As best seen in FIGS. 3 and 4, a lower cylindrical seat 30 extends down from the center of the aperture 28. A pair of opposing guide ways 32, 34 extend diametrically from the aperture 28 and continue downwardly at least partially into layer 22.

The base member 14 is made of insulating material and can be formed of a single unitary piece which is molded to form its particular shape.

An electrically conductive plug member 36 is provided which has a substantially cylindrical lower portion 38 continuing into a frustroconical upper portion 40. Extending in diametrically opposed directions from the lower end of the cylindrical portion 38 are a pair of guide pins 42,44. Electrically secured to one of the guide pins 42, is one side of an electrically conductive wire 46.

Internally of the plug member 36 is provided a threaded bore 48. The plug member 36 is received within the aperture 28 in the base portion 14 with the opposing guide pins 42,44 slideably received within the guide ways 32,34 on either side of the aperture 28. In this way, the plug member 36 can move axially with respect to the base member but is restrained from rotational movement or lateral movement. The positioning of the plug member 36 within the base portion can best be seen in FIGS. 3 and 4.

A lower annular spring collet 50 is formed of conductive material and includes a layer of insulating material 52 on the under surface thereof. The interior of the collet includes a shaped hole 54 corresponding in shape to the boss 26 projecting from the upper level 24 of the base member 14. It likewise includes two corresponding side flats whereby it can be positioned on the boss 26. It is also of a height corresponding to the height of the boss. Thus, as can best be seen in FIGS. 3 and 4, the upper surface 51 of the collet 50, when in place, is substantially flush with the top of the boss 26. Imbedded within the conductive portion of the collet 50 is a second wire 56 electrically connected to the conductive portion of the collet 50.

An electrically conductive hair spring 58 is provided in a spiral configuration and is conically shaped so that the outer turns thereof 60 are larger than their inner turns 62. The upper end of the hair spring 58 is coupled to an annular conductive collar 64. The lower end of the hair spring 66 is conductively connected to the surface 51 of the collet. The connection can be made by forming a hole 68 in the surface 51 of the collet and the lowest turn of the hair spring is either staked or soldered to the collet. Thus, there is an electrical continuity between the annular collar 64, through the hair spring 58 and the collet 50 to the wire 56. As best seen in FIG. 4, the size of the annular collar 64, is such that it sits along the conical surface 40 of the plug member 36. However, because of the conical configuration of the surface 40, the annular collar 64 can move upwardly whereby it is no longer in contact with the conical surface. As it returns back downwardly, it goes back into contact with the conical surface. The hair spring 58, on the other hand, is such that it has its turns extending outwardly beyond the conical surface 40 so that the hair spring will not be in contact with the conical surface at any time.

Through the use of the hair spring, the shock sensor can discriminate between false and actual alarm conditions. This is achieved by allowing the coils of the conically shaped hair spring to vibrate with the natural vibration around it. Only upon sufficient impact to the surface on which it is mounted will the coils of the hair spring vibrate sufficiently to provide the thrust necessary to move the annular collar off the conical surface of the plug causing the alarm to sound.

Referring again to FIG. 1, there is provided an externally threaded pin 70 having an unthreaded foot portion 72 and an unthreaded head portion 74. A socket 76, or the like, is provided in the head portion 74. As best seen in FIG. 4, the threaded pin 70 is secured within the housing by having its foot portion 72 press fit into the seat 30 in the base member 20. The head portion 74 extends through an aperture 78 in the housing. The threaded pin is captured within the housing by having the shoulder portions 80 at the upper ends of the thread retained secured within the underside of the aperture 74 and in the housing. In this manner the threaded pin is restrained from any axial movement within the housing.

The threading on the pin 70 mates with the internally threaded bore 48 of the plug member 36, as best seen in FIG. 4. With the threaded pin inserted within the housing, the recessed socket 76 is externally available to rotate the threaded pin externally of the housing. By rotating the threaded pin, since the pin itself cannot axially move, it causes the plug member 36 to axially move upwardly or downwardly within the housing, depending on the direction that the pin is turned. As the plug member 36 moves axially, the guide pins 42,44 thereon slide within the guide ways 32,34.

By moving the plug member 36 axially upwardly or downwardly, it engages the annular collar 64 to a greater or lesser extent. In this manner, the sensitivity of the shock sensor can be adjusted. By lowering the axial position of the plug member 36, there is less engagement with the collar 64 and the hair spring 58 is less stretched. In this manner, less displacement will cause movement of the annular collar away from the conical surface. On the other hand, by axially moving the plug member upwardly, there is a greater amount of engagement and it requires a greater displacement to separate the annular collar from the conical surface.

With reference now to FIG. 3, there is shown that the shock sensor is connected within an alarm circuit. As is well known, in a closed circuit system the contacts are wired in series. In an open circuit system the contacts are wired in parallel. FIG. 3 schematically shows the wires 46,56 serially connected to a relay 81 and a power source 82. When the shock sensor is opened, the relay moves to energize the alarm 84.

It should be understood, however, that alternately the contacts can be connected in parallel and in this case there will be a normally open circuit with the conical surface adjusted to be out of contact with the annular collar. In that case, a shaking of the sensor will cause contact, whereby the alarm will sound.

The housing is equipped with an aperture 86 to accommodate passage therethrough of the electrical wire. Likewise, the collet 50 is retained in place by means of the shoulders 88 built in the housing to retain the collet stationery on the upper level 24 of the base member 20.

It will, therefore, be noted that the present invention provides for a shock sensor which can discriminate between false and actual alarm conditions and will respond to movement of the member on which it is placed. However, this sensitivity can be adjusted to permit the shock sensor to accommodate numerous situations where sensitivity of the device may require variation.

There has been disclosed heretofore the best embodiment of the invention presently contemplated. However, it should be understood that variations can be made without departing from the spirit of the invention.

I claim:

1. An electrical shock sensor comprising:

an electrically insulating house;

an electrically conductive plug member entirely contained within said housing, having a conical configuration and including means for coupling to one terminal of a source of electrical energy;

an electrically conductive annular collar coaxially positioned over and seated onto said conical configuration to be in engagement therewith;

an electrically conductive spring means connected between said annular collar and a stationary part of said housing and including means for coupling to another terminal of the source of electrical energy, adjusting means for initially adjusting the extent of the stretching of the spring means to initially set the seated axial position of the annular collar along the conical configuration, whereby natural vibrations will cause the spring to oscillate without displacement of the annular collar while impact to the housing causes the spring to jar thereby displacing the annular collar moving it out of engagement with the conical configuration.

2. An electrical shock sensor as in claim 1, wherein said spring means comprise a conically shaped spiral spring coaxially positioned about the plug member.

3. An electrical shock sensor as in claim 2 and further comprising a lower annular spring collet fixedly positioned in said housing, coaxially positioned in spaced relation about said plug member, said spring means being secured to said collet to define said stationary part of the housing.

4. An electrical shock sensor as in claim 3, wherein said collet is of electrically conductive material, and said means for coupling to another terminal comprises an electrical wire secured to said collet.

5. An electrical shock sensor as in claim 4, wherein said means for coupling to one terminal comprises an electrical wire secured to said plug member.

6. An electrical shock sensor as in claim 4, wherein an underside of said collet is insulatively coated to prevent electrical contact with said plug member.

7. An electrical shock sensor as in claim 1, comprising a base member for axially slideably retaining said plug member in said housing.

8. An electrical shock sensor as in claim 7, wherein said plug member comprises a cylindrical lower section and a

9. An electrical shock sensor as in claim 8, and further comprising at least one guide pin radially projecting from said base member and a guide way extending from said cylindrical aperture for receiving said guide pin to prevent rotational movement of said plug member within said base member.

10. An electrical shock sensor as in claim 7, wherein said plug member comprises an interiorly threaded bore, and said adjusting means comprises an externally threaded pin axially captured within said housing and threadedly positioned within said bore, whereby rotation of the pin axially moves said plug member with respect to the base member.

11. An electrical shock sensor as in claim 10, wherein said threaded pin is accessible externally from said housing.

12. An electrical shock sensor as in claim 10, wherein said bore passes entirely through said plug member, said pin comprises a remote end which projects from one end of the bore, and seat means in said base member for receiving said remote end of the pin.

13. An electrical shock sensor as in claim 12, wherein said pin comprises a head at the other end thereof, said head projecting through said housing for external manipulation of said pin, and shoulder means on said pin beneath said head and retained by the housing to thereby axially capture the pin within the housing.

* * * * *